US010080936B2

(12) United States Patent
Sander

(10) Patent No.: US 10,080,936 B2
(45) **Date of Patent: *Sep. 25, 2018**

(54) GOLF CLUB HEAD WITH POLYMERIC FACE

(71) Applicant: Karsten Manufacturing Corporation, Phoenix, AZ (US)

(72) Inventor: Raymond J. Sander, Benbrook, TX (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/995,786

(22) Filed: Jan. 14, 2016

(65) Prior Publication Data

US 2016/0129318 A1 May 12, 2016

Related U.S. Application Data

(63) Continuation of application No. 13/971,222, filed on Aug. 20, 2013, now Pat. No. 9,283,448.

(51) Int. Cl.
*A63B 53/04* (2015.01)
*A63B 60/02* (2015.01)

(52) U.S. Cl.
CPC ..... *A63B 53/047* (2013.01); *A63B 53/0466* (2013.01); *A63B 60/02* (2015.10); *A63B 2053/042* (2013.01); *A63B 2053/0408* (2013.01); *A63B 2053/0425* (2013.01); *A63B 2053/0429* (2013.01); *A63B 2053/0491* (2013.01); *A63B 2209/02* (2013.01)

(58) Field of Classification Search
CPC ... A63B 53/04; A63B 53/047; A63B 53/0466; A63B 2053/0429; A63B 2209/02; A63B 2053/0416; A63B 2053/042; A63B 2053/0425; A63B 2053/0491; A63B 2053/0408; A63B 60/02
USPC ..... 473/324–350, 287–292
See application file for complete search history.

(56) References Cited

U.S. PATENT DOCUMENTS

| | | | | |
|---|---|---|---|---|
| 5,288,070 A | | 2/1994 | Chen | |
| 5,669,827 A | | 9/1997 | Nagamoto | |
| 5,766,094 A | | 6/1998 | Mahaffey et al. | |
| 5,827,131 A | * | 10/1998 | Mahaffey | A63B 53/04 473/342 |
| RE35,955 E | | 11/1998 | Lu | |

(Continued)

FOREIGN PATENT DOCUMENTS

| | | | |
|---|---|---|---|
| GB | 2288743 | A | 1/1995 |
| JP | 2003339926 | A | 12/2003 |

(Continued)

*Primary Examiner* — Sebastiano Passaniti

(57) ABSTRACT

A golf club head includes a body and a face plate insert. The body includes an annular face support having a recessed shelf configured to receive the face plate insert, and partially defining a central cavity. The face plate insert includes a hitting surface and a rear surface that is opposite the hitting surface. The face plate insert is disposed within the annular face such that the rear surface of the face plate insert abuts the recessed shelf. The face plate insert includes a polymeric material that is disposed across the cavity and that has a tensile strength of at least about 220 MPa.

20 Claims, 4 Drawing Sheets

(56) References Cited

U.S. PATENT DOCUMENTS

| | | | | |
|---|---|---|---|---|
| 6,364,789 | B1 * | 4/2002 | Kosmatka | A63B 53/04 473/329 |
| 6,368,231 | B1 | 4/2002 | Chen | |
| 6,428,427 | B1 | 8/2002 | Kosmatka | |
| 6,743,117 | B2 * | 6/2004 | Gilbert | A63B 53/047 473/332 |
| 6,986,715 | B2 | 1/2006 | Mahaffey | |
| 7,022,031 | B2 | 4/2006 | Nishio | |
| 7,115,041 | B2 | 10/2006 | Guard et al. | |
| 7,267,620 | B2 | 9/2007 | Chao et al. | |
| 8,366,566 | B1 | 2/2013 | Rollinson | |
| 8,388,464 | B2 | 3/2013 | Gilbert et al. | |
| 8,491,415 | B2 | 7/2013 | Ishikawa et al. | |
| 8,882,609 | B2 | 11/2014 | Boyd et al. | |
| 9,283,448 | B2 * | 3/2016 | Sander | A63B 53/0466 |
| 2007/0049403 | A1 | 3/2007 | Chen | |
| 2007/0099723 | A1 | 5/2007 | Tateno | |
| 2008/0300068 | A1 * | 12/2008 | Chao | B29C 70/342 473/342 |
| 2010/0151960 | A1 | 6/2010 | Wahl et al. | |
| 2011/0009211 | A1 | 1/2011 | Chao et al. | |
| 2012/0135819 | A1 | 5/2012 | Uetz et al. | |

FOREIGN PATENT DOCUMENTS

| | | | |
|---|---|---|---|
| JP | 2005287667 | A | 10/2005 |
| JP | 2007117635 | A | 5/2007 |
| JP | 2009136514 | A | 6/2009 |
| JP | 2009148558 | A | 7/2009 |
| JP | 2010136736 | A | 6/2010 |
| JP | 2013009735 | A | 1/2013 |
| JP | 2013509909 | A | 3/2013 |

* cited by examiner

GOLF CLUB HEAD WITH POLYMERIC FACE

CROSS REFERENCE TO RELATED APPLICATIONS

This application is a continuation of U.S. patent application Ser. No. 13/971,222, filed on Aug. 20, 2013, which is hereby incorporated by reference in its entirety.

TECHNICAL FIELD

The present invention relates generally to a golf club head having a polymeric face.

BACKGROUND

A golf club may generally include a club head disposed on the end of an elongate shaft. During play, the club head may be swung into contact with a stationary ball located on the ground in an effort to project the ball in an intended direction and with a desired vertical trajectory. This impact may generate momentary impact forces on the club face that can peak in the range of about 6520 N to about 18000 N (about 1520 lbf to about 4000 lbf).

Many design parameters must be considered when forming a golf club head. For example, the design must provide enough structural resilience to withstand repeated impact forces between the club and the ball, as well as between the club and the ground. The club head must conform to maximum size requirements set by different rule setting associations, and the face of the club must not have a coefficient of restitution above a predefined maximum (measured according to applicable standards). Assuming that certain predefined design constraints are satisfied, a club head design for a particular loft is typically quantified by the magnitude and location of the center of gravity, as well as the head's moment of inertia about the center of gravity and/or the shaft.

The club's moment of inertia relates to the club's resistance to rotation (particularly during an off-center hit), and is often perceived as the club's measure of "forgiveness." In typical club designs, high moments of inertia are desired to reduce the club's tendency to push or fade a ball. Achieving a high moment of inertia generally involves moving mass as close to the perimeter of the club as possible (to maximize the moment of inertia about the center of gravity), and as close to the toe as possible (to maximize the moment of inertia about the shaft).

While the moment of inertia affects the forgiveness of a club head, the location of the center of gravity behind the club face (and above the sole) generally affects the trajectory of a shot for a given face loft angle. A center of gravity that is positioned as far rearward (away from the face) and as low (close to the sole) as possible typically results in a ball flight that has a higher trajectory than a club head with a center of gravity placed more forward and/or higher.

While a high moment of inertia is obtained by increasing the perimeter weighting of the club head, an increase in the total mass/swing weight of the club head (i.e., the magnitude of the center of gravity) has a strong, negative effect on club head speed and hitting distance. Said another way, to maximize club head speed (and hitting distance), a lower total mass is desired; however a lower total mass generally reduces the club head's moment of inertia (and forgiveness).

In the tension between swing speed (mass) and forgiveness (moment of inertia), it may be desirable to place varying amounts of mass in specific locations throughout the club head to tailor a club's performance to a particular golfer or ability level. In this manner, the total club head mass may generally be categorized into two categories: structural mass and discretionary mass.

Structural mass generally refers to the mass of the materials that are required to provide the club head with the structural resilience needed to withstand repeated impacts. Structural mass is highly design-dependent, and provides a designer with a relatively low amount of control over specific mass distribution. On the other hand, discretionary mass is any additional mass that may be added to the club head design for the sole purpose of customizing the performance and/or forgiveness of the club. In an ideal club design, the amount of structural mass would be minimized (without sacrificing resiliency) to provide a designer with a greater ability to customize club performance, while maintaining a traditional or desired swing weight.

In the interest of minimizing the total structural mass, most metal woods, for example, generally employ a thin metal face and hollow structural shell formed from a high strength, lightweight metal alloy. Such a design, while effective in reducing structural mass, may involve complex, multi-stage manufacturing processes, and may be limited in further advancements due to the cost prohibitive nature of more advanced alloys.

SUMMARY

A golf club head includes a body and a face plate insert. The body includes an annular face support having a recessed shelf configured to receive the face plate insert, and partially defining a central cavity. The face plate insert includes a hitting surface and a rear surface that is opposite the hitting surface. The face plate insert is disposed within the annular face such that the rear surface of the face plate insert abuts the recessed shelf. The face plate insert includes a polymeric material that is disposed across the cavity and that has a tensile strength of at least about 220 MPa. In one configuration, the polymeric material is a polyamide that may be glass-fiber filled, carbon-fiber filled, or graphite-fiber filled.

In one configuration, the face plate insert may be a laminate that is formed from a metallic hitting plate disposed in contact with the polymeric material. In such a configuration, the metallic hitting plate may then form the hitting surface of the face plate insert. The metallic hitting plate may be mechanically bonded and/or co-molded to the polymeric material via one or more protrusions that extend from the metallic hitting plate into the polymeric material. Such protrusions may be trapped within the polymeric material layer, for example, during an overmolding process to apply the polymeric material to a rear side of the metallic hitting plate. The metallic hitting plate may then include a plurality of grooves that are recessed into the hitting surface and concave relative to the metallic hitting plate.

In one configuration, the laminate may further include a metallic rear plate that is disposed in contact with the polymeric material, and which forms the rear surface of the face plate insert. As such, the metallic hitting plate may be disposed on an opposite side of the polymeric material from the metallic rear plate (i.e., the various layers forma metal-polymer-metal laminate).

In one configuration, the golf club head may be an iron-type club head, wherein the central cavity is an open cavity. By "open cavity" it is intended to mean that the body and face plate insert cooperate to only partially surround the open cavity. In another configuration, the golf club head may be a wood-type club head (e.g., metal wood, driver, fairway wood, or hybrid iron), wherein the central cavity is a closed cavity. By "closed cavity" it is intended to mean that the body and face plate insert cooperate to entirely surround the closed cavity.

The above features and advantages and other features and advantages of the present invention are readily apparent from the following detailed description of the best modes for carrying out the invention when taken in connection with the accompanying drawings.

DETAILED DESCRIPTION

Figure 1:
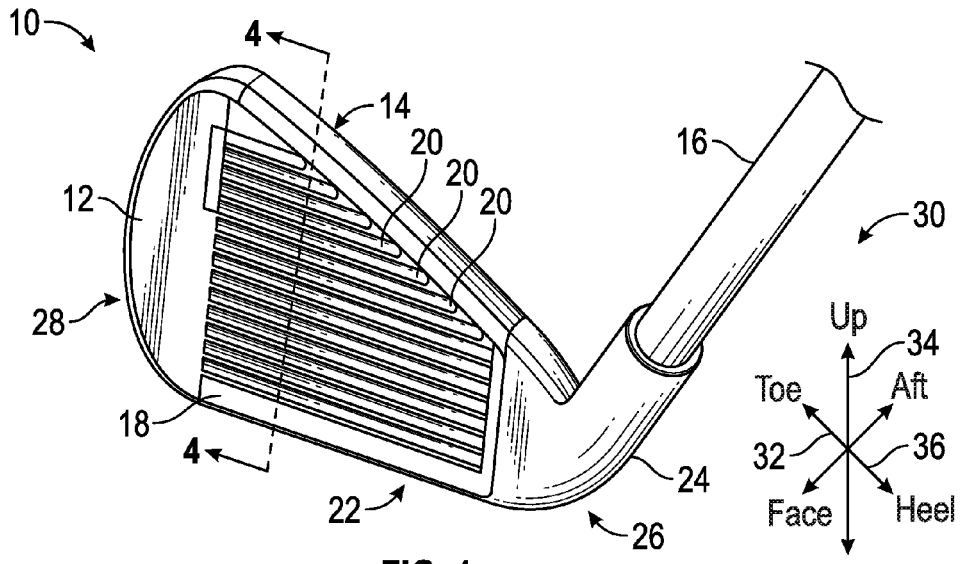
FIG. 1 is a schematic perspective view of a golf club head.

Referring to the drawings, wherein like reference numerals are used to identify like or identical components in the various views, FIG. 1 illustrates a schematic perspective view of an iron-type golf club head 10 (i.e., "club head 10") that generally includes a face plate 12 and a body portion 14 (i.e., the "body 14"). As generally illustrated in FIG. 1, the club head 10 may be mounted on the end of an elongate shaft 16, which may, in turn, be gripped and swung by a user to impart a generally arcuate motion to the club head 10 during a typical swing.

The face plate 12 of the club head 10 may generally define a hitting surface 18 that is intended to contact a golf ball during a normal swing. The hitting surface 18 includes a plurality of grooves 20 that are recessed into the face plate 12 in a generally concave manner. The hitting surface 18 may either be substantially planar, or may have a slight convex or arcuate curvature that extends out from the club head 10. As is commonly understood, the hitting surface 18 may be disposed at an angle to a vertical plane when the club is held in a neutral hitting position. This angle may be generally referred to as the loft angle or slope of the club. Wood-type club heads (including hybrid woods) may most commonly have a loft angle of from about 8.5 degrees to about 24 degrees, while iron-type clubs may most commonly have loft angles from about 18 degrees to about 60 degrees, though other loft angles are possible and have been commercially sold.

The body 14 of the club head 10 may generally be configured to support the face plate 12 and to provide a connection means between the face plate 12 and the elongate shaft 16. With continued reference to FIG. 1, the body 14 may generally include a lower portion 22 (i.e., a "sole 22"), a hosel 24, a heel portion 26, and a toe portion 28. The hosel 24 may be located proximate the heel portion 26, and may be configured to receive and/or otherwise couple the head 10 with the elongate shaft 16. Axes 30 further define directionally-related portions of the club head 10, including a fore-aft axis 32 extending through the face 14 (generally indicating front and rear portions/directions of the club head 10), a vertical axis 34 extending perpendicular to the fore-aft axis 32, and a toe-heel axis 36 extending perpendicular to both the fore-aft axis 32 and the vertical axis 34.

Figure 2:
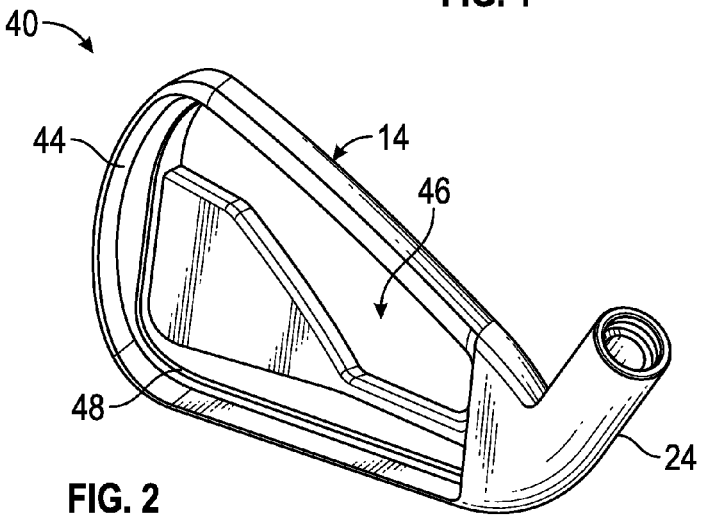
FIG. 2 is a schematic front perspective view of a golf club body.
Figure 3:
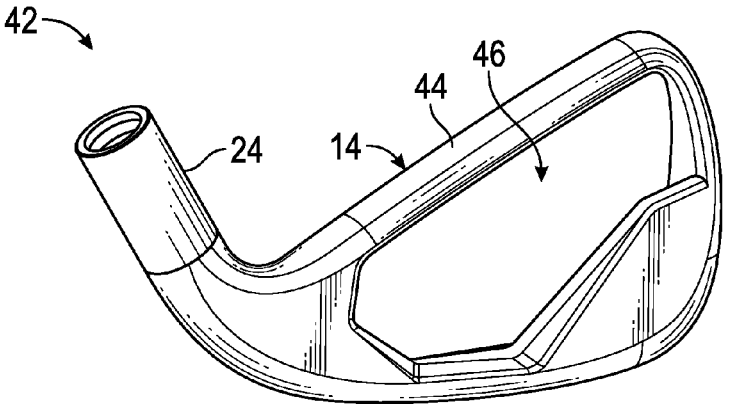
FIG. 3 is a schematic rear perspective view of a golf club body.

FIGS. 2 and 3 generally illustrate schematic perspective views of the body 14, taken from both a front direction (i.e., the view 40 provided in FIG. 2) and a rear direction (i.e., the view 42 provided in FIG. 3). As shown, the body 14 generally includes an annular face support 44 that defines a central cavity 46, and includes a stepped inner surface 48 (i.e., a "recessed shelf 48") configured to receive and support the face plate 12. In this manner, the club may be considered a "cavity back" club, where club head mass is pushed toward the outer perimeter, leaving a void or "cavity" 46 in a central region of the club.

The body 14 may typically be a metal or metal alloy that is formed into a proper shape using either a casting or forging process. Examples of suitable metal alloys include steel (e.g., AISI type 1020 or AISI type 8620 steel), stainless steel (e.g., AISI type 304 or AISI type 630 stainless steel) or titanium (e.g., Ti-6Al-4V Titanium alloy), however other metal alloys, metal amorphous alloys, and/or non-metallic materials known in the art may similarly be used.

Figure 4A:
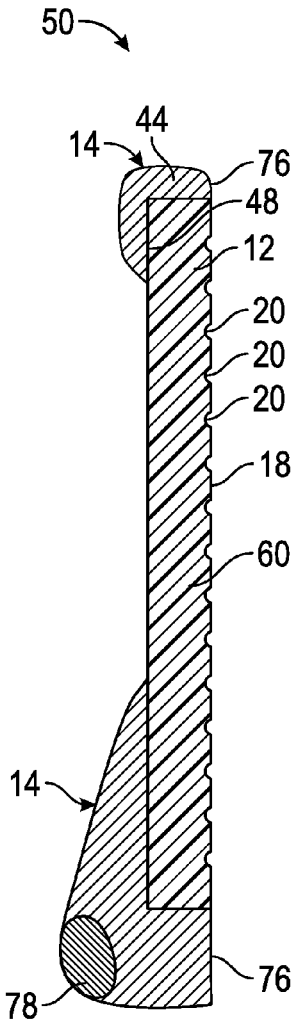
FIG. 4A is a schematic cross-sectional view of a first embodiment of an open cavity golf club with a polymeric face plate.
Figure 4B:
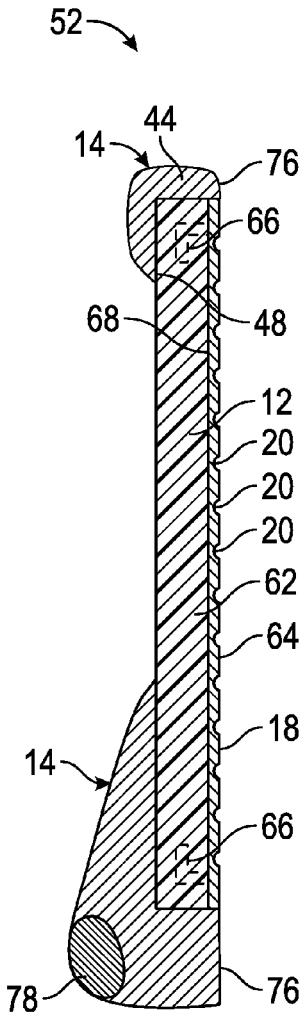
FIG. 4B is a schematic cross-sectional view of a second embodiment of an open cavity golf club with a polymeric face plate, such as taken along line 4-4 of FIG. 1.
Figure 4C:
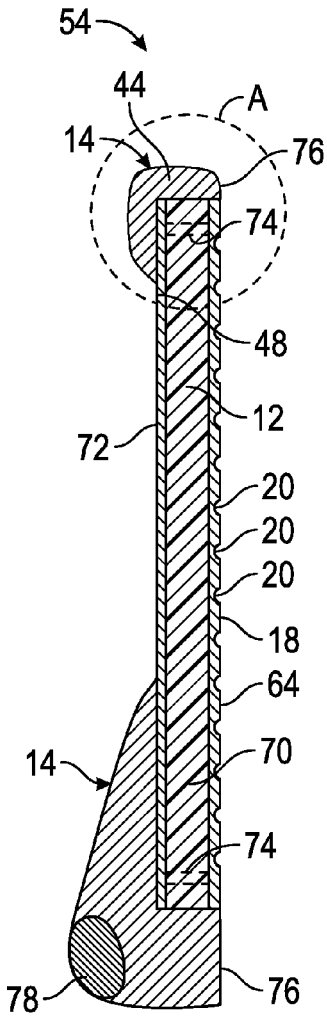
FIG. 4C is a schematic cross-sectional view of a third embodiment of an open cavity golf club with a polymeric face plate, such as taken along line 4-4 of FIG. 1.

FIGS. 4A, 4B, and 4C illustrate three schematic cross-sectional embodiments 50, 52, 54 (respectively) of a golf club head 10 similar to the head 10 illustrated in FIG. 1. In particular, each embodiment 50, 52, 54 respectively illustrates a face plate 12 affixed to a metallic body 14. To reduce structural mass of the face plate 12 beyond what is economically viable with metal alloys, the face plate 12 in each embodiment may include a layer that is formed from a polymeric material having a yield strength that is great enough to withstand the repeated stress imparted by the ball impact. Examples of such materials may include certain polyamides, polyimides, polyamide-imides, polyetheretherketones (PEEK), polycarbonates, engineering polyurethanes, and/or other similar materials. In general, the polymeric material may be either thermoplastic or thermoset, and may be unfilled, glass fiber-filled, carbon fiber-filled, graphite fiber-filled, or may have other suitable fillers including other fibers, particulate fillers, and/or additives to promote increased strength. In one configuration, a suitable material may have a tensile strength of at least about 180 MPa, while in other configurations it may have a tensile strength of at least about 200 MPa or at least about 220 MPa.

As generally illustrated, FIG. 4A illustrates an embodiment 50 of a golf club head 10 where the entire face plate 12 is formed from a polymeric material/composite (i.e., an "all-polymer" face plate 60). The all-polymer faceplate 60 may be formed from a thermoplastic or thermoset material, for example, through an injection molding, compression molding, thermoforming, or other such process. The molding process may integrally form the plurality of grooves 20 into the front, hitting surface of the face plate 12.

FIG. 4B generally illustrates an embodiment 52 of a golf club head 10, where the face plate 12 includes a polymeric base layer 62 fused to a metallic hitting plate 64. Such a design may make the face plate 12 more resilient against scratches and/or other surface wear than an all-polymer face plate design 60. Non-limiting examples of materials that may be used to form the metallic hitting plate 64 include stainless steel (e.g., AISI type 304 or AISI type 630 stainless steel) or titanium (e.g., Ti-6Al-4V Titanium alloy), however other metal alloys, amorphous metal alloys, and/or non-metallic materials known in the art may also be used.

In the embodiment 52 provided in FIG. 4B, the metal hitting plate 64 may, for example, be fabricated first, with the polymeric base layer 62 being over molded onto the rear side of the hitting plate 64. This may result in the polymeric base layer 62 being mechanically and/or chemically bonded to the metallic hitting plate 64. Examples of mechanical bonding may include embedding one or more mechanical fasteners 66 that extend from the hitting plate 64 into the polymeric base layer 62 during the overmolding process. These mechanical fasteners 66 may include, for example, one or more tabs, posts, hooks, dovetail protrusions, or other such interlocking features that extend from a rear surface 68 of the hitting plate 64. Once over molded with the polymer, these mechanical fasteners 66 may be surrounded and trapped within the polymeric layer 62 to facilitate the mechanical coupling.

Finally, FIG. 4C generally illustrates an embodiment 54 of a golf club head 10, where the face plate 12 includes a polymeric layer 70 disposed between a metallic hitting plate 64 and a metallic rear plate 72 (i.e., where the hitting plate 64 and rear plate 72 are disposed on opposing sides of the polymeric layer 70). Similar to the embodiment 52 described in FIG. 4B, the metallic hitting plate 64 increases the resiliency of the face plate 12 against scratches and/or other surface wear. This embodiment 54 may include one or more supporting posts 74 that extend between the hitting plate 64 and rear plate 72 to form a mechanical bonding between the two plates 64, 72. The polymeric layer 70 may then be injection molded between the two plates 64, 72 such that the material surrounds the one or more supporting posts to firmly lock the polymeric layer 70 in place. While this is one manner of constructing such a laminate, other methods may similarly be used so long as there is a secure bond between the polymeric layer and the one or more metallic layers. Such methods may include the use of coarse surface finishes on the metallic layer to facilitate mechanical interconnection, the use of chemical adhesives such as epoxy adhesives, and/or clips/fasteners that may apply a pressure load between the respective layers. While FIGS. 4B and 4C illustrate two different metal-polymer laminate configurations for the face plate 12, other laminate configurations may similarly be possible, including a metal rear plate 72 with a polymeric hitting surface 18 and/or one or more metal support plates embedded within the polymer layer.

As further illustrated in FIGS. 4A, 4B, and 4C, the shelf 48 may be recessed away from a front surface 76 of the annular face support 44 by a distance that is about equal to the width of the face plate 12. In this manner, the hitting surface 18 of the face plate 12 may be about flush with the front surface 76 of the annular face support 44 when the face plate 12 is disposed within the annular face support 44 and abuts the recessed shelf 48. In one configuration, the face plate 12 may have a width proximate the outer edge (i.e., excluding any grooves) of from about 2 mm to about 6 mm, however, wider or narrower face plates 12 may similarly be used.

The use of a polymer layer in the face plate 12 may reduce the mass of the face plate by up to about 30 g. If desired, this mass may then be redistributed throughout the club body 14 as discretionary weight (i.e., it may be specifically positioned at the discretion of the club designer). For example, this mass may be distributed around the perimeter of the body 14 (i.e., pushed from the face plate outward toward the annular face support 44) to increase the moment of inertia of the club head 10; alternatively, the mass may be concentrated at specific locations to alter/move the center of gravity of the club head 10 (e.g., to move the center of gravity more proximate to the sole 22 (i.e., lower), toe portion 28, and/or rearward from the face plate 12). For example, as shown in each of FIGS. 4A, 4B, and 4C, a weight 78 may be embedded, or otherwise affixed to the body 14 of the club head 10 toward a rear portion 80 of the sole 22. The weight 78 may for example, be a metallic weight, such as a tungsten weight, which has a generally high material density (i.e., mass/volume) as compared with other metals. In one configuration, the weight may be selectively removable, such as by being screwed in place. In another configuration, the weight may be entirely integrated within the club such that it may not be removed without causing damage to the club head 10.

Figure 5A:
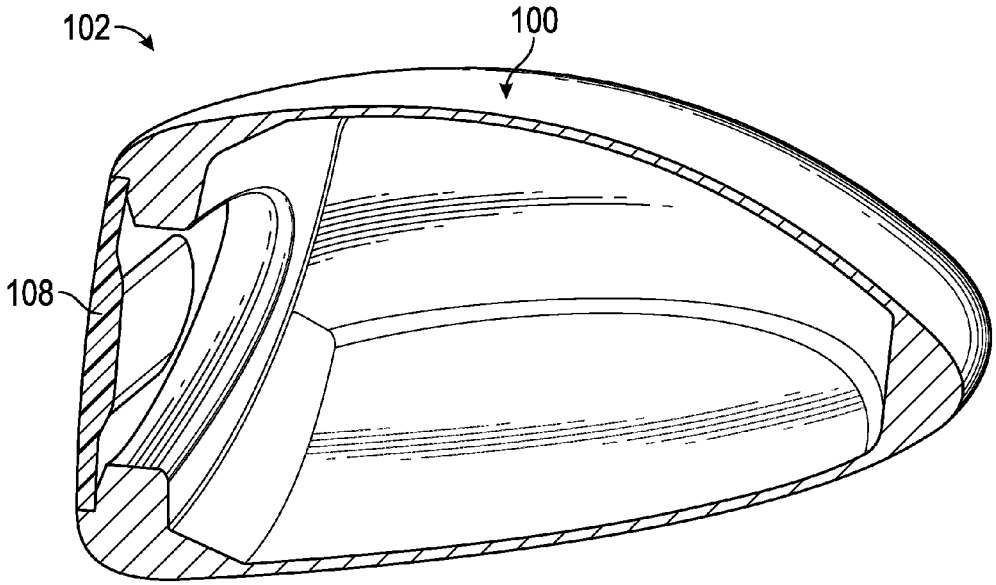
FIG. 5A is a schematic cross-sectional view of a first embodiment of an closed cavity golf club with a polymeric face plate, such as taken along line 4-4 of FIG. 1.
Figure 5B:
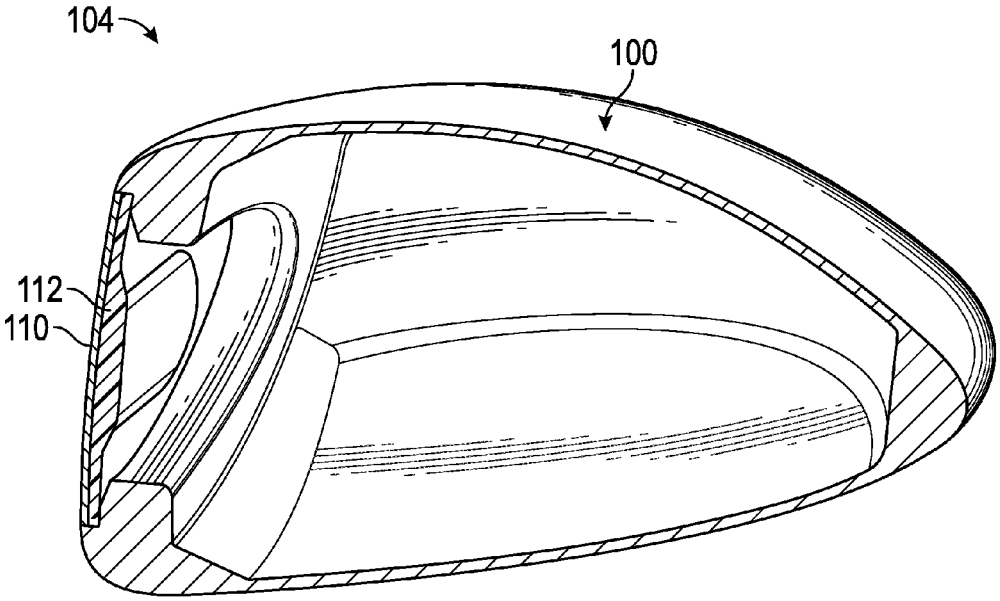
FIG. 5B is a schematic cross-sectional view of a second embodiment of an closed cavity golf club with a polymeric face plate.
Figure 5C:
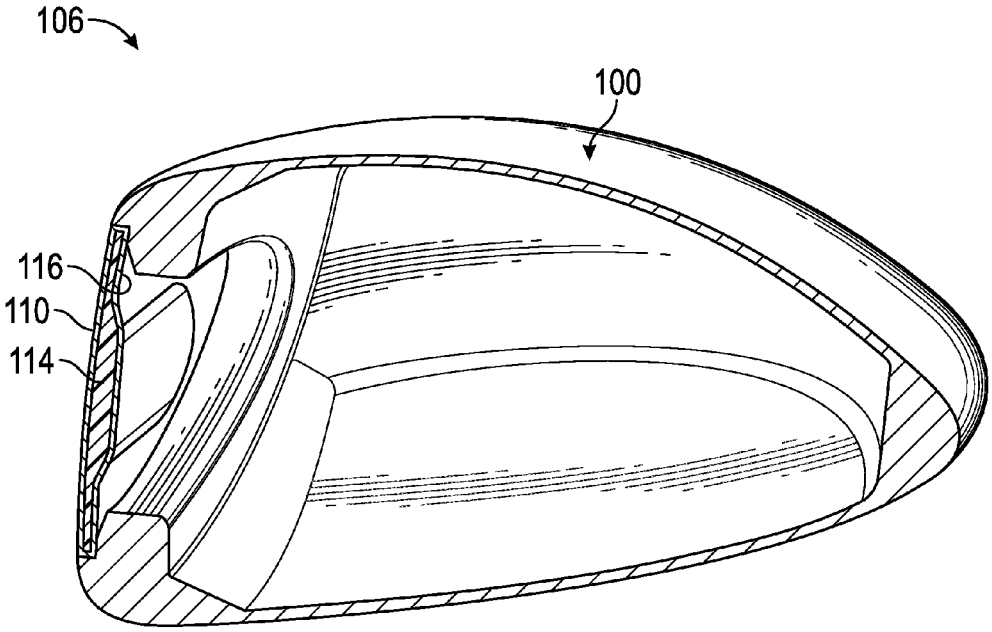
FIG. 5C is a schematic cross-sectional view of a third embodiment of an closed cavity golf club with a polymeric face plate.

While FIGS. 1-4C illustrate the polymeric face plate construction with respect to an iron-type club head 10 (i.e., an "open cavity" club head), these polymeric face plate designs may similarly be used with a "closed cavity," wood-type club head 100, such as generally illustrated in the embodiments 102, 104, 106 provided in FIGS. 5A, 5B, and 5C. As used herein, a closed cavity club head is one where the face plate 12 and body 14 cooperate to entirely surround a cavity, rather than only partially surround the cavity as with an open cavity club head.

Similar to the iron embodiments 50, 52, 54 provided in FIGS. 4A, 4B, and 4C, FIG. 5A illustrates a club head embodiment 102 with a face plate 108 having an all-polymer construction, FIG. 5B illustrates a club head embodiment 104 with a face plate having a metal hitting surface 110 affixed to a polymeric base layer 112, and FIG. 5C illustrates a club head embodiment 106 with a face plate having a polymeric layer 114 disposed between a metal hitting surface 110 and a metallic rear plate 116 (i.e., with the hitting plate 110 and rear plate 116 disposed on opposing sides of the polymeric layer 114).

FIG. 5C further illustrates an embodiment where the face plate has a non-uniform thickness. Specifically, the face plate includes a central region that is surrounded by a peripheral region, with the central region having a greater thickness than the peripheral region. In such an embodiment, the central region may inwardly protrude into the internal cavity in relief relative to the peripheral region. As shown, the metal hitting plate 110 and the metallic rear plate 116 may each have a substantially uniform thickness, while the thickness of the polymeric layer 114 may be thicker in the central region than the surrounding peripheral region. Such an arrangement may provide the rear plate 116 with a non-planar surface geometry. FIG. 5C further illustrates an embodiment where the metallic hitting plate 110 and metallic rear plate 116 are joined at an edge portion to encapsulate the polymeric layer 114.

Figure 6:
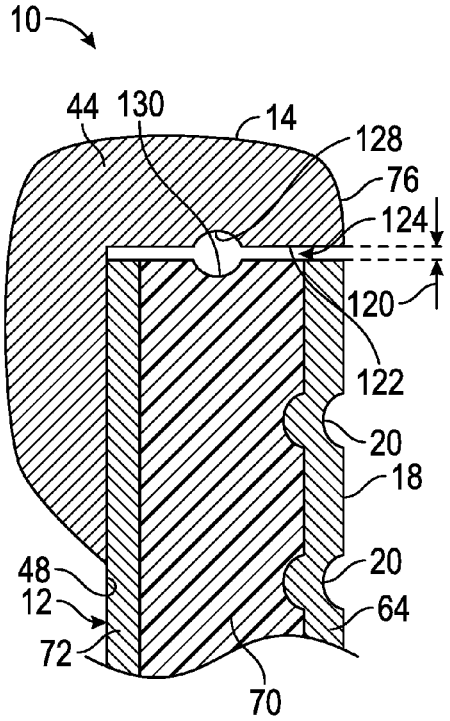
FIG. 6 is an enlarged schematic partial cross-sectional view of the interface between the body and face plate of a golf club head, such as taken from the region-A of FIG. 4C.
Figure 7:
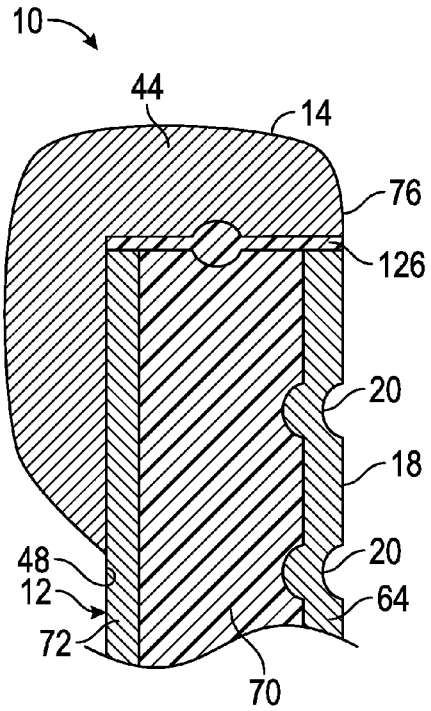
FIG. 7 is an enlarged schematic partial cross-sectional view of the golf club head of FIG. 6, including a bonding material disposed between the body and face plate.

FIGS. 6 and 7 illustrate an enlarged schematic cross-sectional view of a portion of a club head 10 similar to the region-A of the embodiment 54 provided in FIG. 4C. In particular, FIGS. 6 and 7 generally illustrate a manner for affixing a face plate 12 to a club body 14, such as using an epoxy adhesive, a cyanoacrylate adhesive, or other resinous, curable materials (generally referred to as a "bonding material").

As generally illustrated in FIG. 6, the face plate 12 may be spaced a distance 120 from an inner sidewall 122 of the annular face support 44. This distance 120 may be relatively small, but sufficient to form a channel 124 capable of receiving a thin layer of bonding material 126 (shown in FIG. 7). In one configuration, the distance 120 may, for example and without limitation, be about 0.1 mm to about 0.5 mm. To increase the bonding strength between the face plate 12 and the body 14 beyond merely the shear strength of the bonding material 126, the channel 124 may further be structured to facilitate a mechanical bond. For example, a first recess 128 may be disposed within the inner sidewall 122 of the annular face support 44, and a second recess 130 may be disposed within the face plate 12 at an opposite side of the channel 124. In another embodiment, only a single recess 130 may be present in the face plate 12 to facilitate the mechanical bond (i.e., omitting the recess 128 in the body 14).

As generally shown in FIG. 7, the channel 124 between the face plate 12 and the annular face support 44 may be filled with a resinous bonding material 126 to secure the face plate 12 to the body 14 of the club head 10. The bonding material 126 may fill both of the first and second recesses 128, 130, and (once hardened) may form a mechanical interlock that may enhance the holding strength of the bond (i.e., beyond merely the shear strength of the bonding material 126). While only a cross-section of the first and second recesses 128, 130 are shown, they may extend around either a portion or the entire perimeter of the face plate 12 and annular face support 44.

While the best modes for carrying out the invention have been described in detail, those familiar with the art to which this invention relates will recognize various alternative designs and embodiments for practicing the invention within the scope of the appended claims. It is intended that all matter contained in the above description or shown in the accompanying drawings shall be interpreted as illustrative only and not as limiting.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; about or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range. Each value within a range and the endpoints of a range are hereby all disclosed as separate embodiment. In this description of the invention, for convenience, "polymer" and "resin" are used interchangeably to encompass resins, oligomers, and polymers. The terms "comprises," "comprising," "including," and "having," are inclusive and therefore specify the presence of stated items, but do not preclude the presence of other items. As used in this specification, the term "or" includes any and all combinations of one or more of the listed items. In other words, "or" means "and/or." When the terms first, second, third, etc. are used to differentiate various items from each other, these designations are merely for convenience and do not limit the items.

The invention claimed is:

1. A golf club head comprising:

a body including an annular face support having a recessed shelf and partially defining a central cavity;

a face plate insert having a hitting surface and a non-planar rear surface opposite the hitting surface, the face plate insert affixed to the body across the central cavity such that the non-planar rear surface of the face plate insert abuts the recessed shelf; the face plate insert including:

a metallic hitting plate forming the hitting surface and having a substantially uniform thickness;

a metallic rear plate forming the non-planar rear surface and having a substantially uniform thickness;

a polymeric layer disposed between the metallic hitting plate and the metallic rear plate, the polymeric layer consisting of a filled or unfilled thermoplastic polymer wherein the polymeric layer includes a central region surrounded by a peripheral region, and wherein the central region is thicker than the peripheral region.

2. The golf club head of claim 1, wherein the filled or unfilled thermoplastic polymer has a tensile strength of at least about 220 MPa.

3. The golf club head of claim 1, wherein the annular face support includes a forward wall abutting an edge of the face plate insert; and wherein the forward wall of the annular face support is flush with the hitting surface of the face plate insert when the face plate insert abuts the recessed shelf.

4. The golf club head of claim 1, wherein the metallic hitting plate is mechanically bonded to the polymeric layer through a protrusion that is affixed to each of the metallic hitting plate and the metallic rear plate, and extends through the polymeric layer.

5. The golf club head of claim 1, wherein the central cavity is an open cavity such that the body and face plate insert cooperate to only partially surround the open cavity.

6. The golf club head of claim 1, wherein the central cavity is a closed cavity such that the body and face plate insert cooperate to entirely surround the closed cavity.

7. The golf club head of claim 1, wherein the face plate insert has a thickness of from about 2 mm to about 6 mm.

8. The golf club head of claim 1, wherein the filled or unfilled thermoplastic polymer is a polyamide that is either glass-fiber filled or carbon-fiber filled.

9. The golf club head of claim 1, wherein the annular face support has an inner side wall that is adjacent to the recessed shelf;

wherein the face plate insert is spaced from the inner side wall to define an adhesive channel between the face plate insert and the inner side wall when the non-planar rear surface of the face plate insert abuts the recessed shelf; and wherein at least one of the inner side wall and the face plate insert defines a recess in communication with the adhesive channel.

10. The golf club head of claim 9, further comprising an adhesive provided within both the adhesive channel and the recess to affix the face plate insert to the annular face support.

11. The golf club head of claim 1, wherein the metallic hitting plate and the metallic rear plate are joined along an edge portion to encapsulate the polymeric layer.

12. A golf club head comprising:

a body including an annular face support having an inner side wall adjacent to a recessed shelf, the annular face support partially defining a central cavity; and a face plate insert having a hitting surface and a rear surface opposite the hitting surface, the face plate insert received by the annular face support and affixed to the body across the central cavity such that the rear surface of the face plate insert abuts the recessed shelf and such that the face plate insert is spaced from the inner side wall to define an adhesive channel between the face plate insert and the inner side wall;

wherein at least one of the inner side wall and the face plate insert defines a recess in communication with the adhesive channel; and wherein the face plate insert is a laminate including a metallic hitting plate forming the hitting surface and a polymeric layer abutting the metallic hitting plate and consisting of a filled or unfilled thermoplastic polymer.

13. The golf club head of claim 12, further comprising an adhesive provided within both the adhesive channel and the recess to affix the face plate insert to the annular face support.

14. The golf club head of claim 12, wherein the face plate insert further includes a metallic rear plate that forms the rear surface, and wherein the polymeric layer is disposed between the metallic hitting plate and the metallic rear plate.

15. The golf club head of claim 12, wherein the polymeric layer includes the filled or unfilled thermoplastic polymer with a tensile strength of at least about 220 MPa.

16. The golf club head of claim 12, wherein the annular face support includes a forward wall abutting an edge of the face plate insert, and wherein the forward wall of the annular face support is flush with the hitting surface of the face plate insert when the face plate insert abuts the recessed shelf.

17. The golf club head of claim 12, wherein the central cavity is an open cavity such that the body and face plate insert cooperate to only partially surround the open cavity.

18. The golf club head of claim 12, wherein the central cavity is a closed cavity such that the body and face plate insert cooperate to entirely surround the closed cavity.

19. The golf club head of claim 12, wherein the face plate insert has a thickness of from about 2 mm to about 6 mm.

20. The golf club head of claim 12, wherein the polymeric layer includes the filled or unfilled thermoplastic polymer that is a polyamide that is either glass-fiber filled or carbon-fiber filled.

* * * * *